US005139167A

United States Patent [19]

McCarthy

[11] Patent Number: 5,139,167

[45] Date of Patent: Aug. 18, 1992

[54] BLADE DISPENSER

[76] Inventor: William C. McCarthy, 2609 NW. 6th Terrace, Wilton Manors, Fla. 33311

[21] Appl. No.: 568,991

[22] Filed: Aug. 17, 1990

[51] Int. Cl.[5] ..... B65G 59/00

[52] U.S. Cl. ..... 221/312 A; 206/354; 224/183; 224/252

[58] Field of Search ..... 221/185, 191, 302-303, 221/312 R-312 C; 206/352, 354, 359-360; 224/183, 196, 252, 269

[56] References Cited

U.S. PATENT DOCUMENTS

| | | | |
|---|---|---|---|
| 1,863,074 | 6/1932 | Swan | 206/354 |
| 1,909,429 | 5/1933 | Sherman | 206/354 |
| 2,792,933 | 5/1957 | Butlin | 206/359 |
| 4,530,445 | 7/1985 | Decker | 221/312 A |
| 5,016,766 | 5/1991 | Klein | 221/312 A X |

FOREIGN PATENT DOCUMENTS

| | | | |
|---|---|---|---|
| 898096 | 4/1972 | Canada | 221/312 A |

*Primary Examiner*—David H. Bollinger
*Attorney, Agent, or Firm*—Malin, Haley, McHale, DiMaggio & Crosby

[57] ABSTRACT

A safety blade magazine for storing, transporting and dispensing individually a large number of single edge safety blades. The magazine is essentially an elongated rectangular box having an opening or slot at the base of one wall and a thumb shaped recess along the bottom wall for dispensing a single blade at a time out of the slot in the bottom of the box. The magazine also includes an elongated spindle centrally disposed from its top to within one blade width of the dispensing slot in length, the spindle capable of holding one hundred razor blades through the blade apertures in the center of the single edge blades. A small magnet is disposed on the outside wall just above the dispensing slot which acts to stabilize the blades in the magazine and also to assist in dispensing whenever the thumb actuated recess to manually dispense the blades is utilized. Finally the magnet serves to temporarily hold a blade that has already been dispensed. The safety blades are installed in the box at the factory on the spindle and the spindle top wall and a side wall are then joined to the remainder of the box which is then taped in a closed position. The spindle may include a washer-like lock that rests upon the blades to keep them together on the spindle.

5 Claims, 1 Drawing Sheet

FIG. 1.
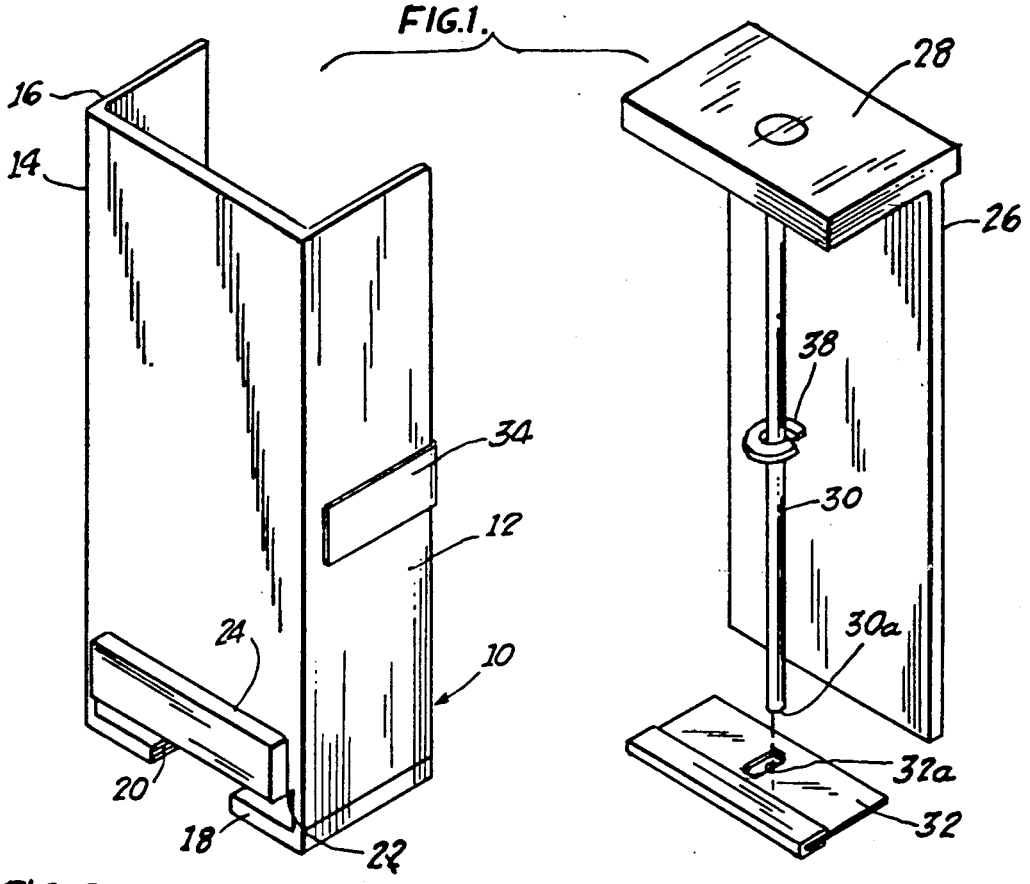
FIG. 2.
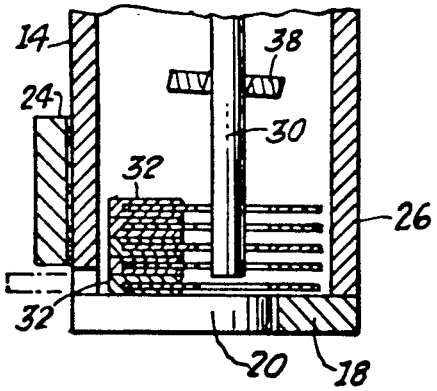
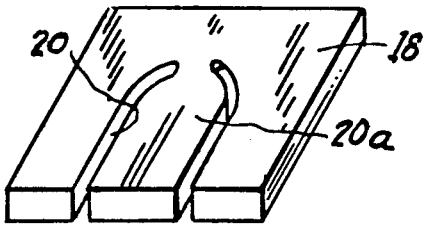
FIG. 3.
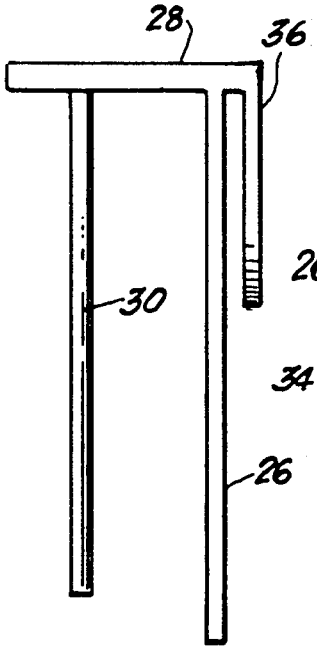
FIG. 4.
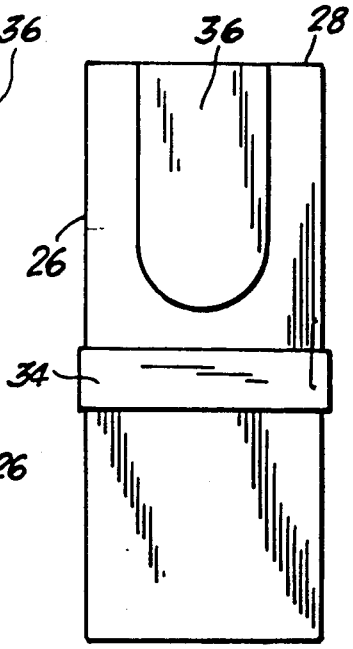
FIG. 5.

BLADE DISPENSER

BACKGROUND OF THE INVENTION

1 Field of the Invention

This invention relates generally to a safety razor blade dispensing device, and in particular to a single edge razor blade storage, transport, and dispensing device which can store a large amount (one hundred single edge razor blades) for individual dispensing.

2. Description of the Prior Art

Blade dispensing devices are known in the prior art. U.S. Pat. No. 2,272,444 shows a magazine-like device that includes a magnet to position the blade for easy grasping by the user. The magazine in this case is primarily intended for dispensing razor blades for shaving.

Although used in shaving, single edge safety blades are widely used by skilled craftsman who expend several blades while working at their craft, such as wallpaper hanging or other crafts that require cutting with a single edge blade. Heretofore such a craftsman would purchase a large box of individually wrapped razor blades and would stop the work operation to retrieve a new blade when necessary. As stated before, it is not uncommon to use several blades during a days work, which means several interruptions throughout the work day just to retrieve one new single edge blade. Single edge safety blades are also used in tools for scraping, paint removal, shaving wood. U.S. Pat. No. 4,759,441 shows a combination tool for use in hanging wallpaper which includes a blade dispenser of very small volume.

The present invention is of great utility to the craftsman who can carry or use several blades during a work operation. The magazine utilized in the present invention can safely and comfortably hold one hundred single edge safety-type razor blades each of which can be individually dispensed quickly and efficiently. The present invention further includes a magnet that acts to stabilize the blades while at the same time allowing the craftsman to retain a blade currently in use while doing another operation by quick attachment to the magnet.

SUMMARY OF THE INVENTION

A device for storing, transporting and dispensing single edge safety razor blades comprising an elongated rectangular receptacle having first, second and third rectangular walls unitarily attached to a rectangular floor, the floor being such to accommodate the width and length of a single edge razor blade, said second wall having an opening adjacent the floor, said opening being sized to allow the thickness of a single edge safety razor blade to pass therethrough. The receptacle also includes a fourth rectangular wall which is attached to a rectangular top, shaped and sized the same as the bottom floor, an elongated thin spindle attached to the center of the top and disposed downwardly, the length of the spindle being sized so it is sufficiently spaced at its end tip from the bottom floor so that it will not engage the bottom most safety razor blade disposed in the receptacle. The spindle is used to engage the central aperture found in conventional safety blades and is sized so that one hundred safety razors can be stacked and mounted on the spindle.

Adjacent the lowermost edge of the second wall near the opening at the bottom of the dispenser is a small magnet permanently attached to the outside second wall near the opening of the base. The magnet has sufficient magnetic force that it will interacts magnetically with blades that are disposed within the dispenser adjacent the dispensing opening mounted on the spindle.

The floor includes a recessed portion shaped much as the thickness of a finger or thumb protruding inwardly from the opening formed by the second wall and the floor which allows the user to grasp the bottom most razor blade that is lying on the floor, a portion of which will be overlapping over the recessed portion in the floor.

A blade retaining device is also mounted on the spindle on top of the uppermost blade where it rests by gravity and acts much like a lock washer to prevent the blades from being moved upwardly while they are positioned on the spindle. As each blade is dispensed, the retaining mechanism will drop by gravity so that it maintain contact with the topmost blade at all times. Because of the shape of the lock washer, any movement upwardly by the blades will turn the retaining member to frictionally engage the spindle preventing upward movement of the blades such as during transport or the like.

The three side walls and bottom are initially separated from the fourth side walls and top containing the spindle so that the blades can be mounted on the spindle before the units are joined during the installation of the blades at the factory. Once the two segments of the dispensing receptacle are joined together, tape can be used to firmly hold them together by placing segments of tape about the perimeter walls firmly holding the unit together.

The blade dispenser in accordance with the invention also includes a fastener for attaching the entire dispensing receptacle to the user's belt or other article of clothing so that the entire device can be carried conveniently by the user.

The magnet used with the present invention has several functions which include holding the blades down (functioning like additional gravity) and aiding in dispensing a blade while holding down the last blade. The magnet also allows a blade that has already been taken from the dispenser to be temporarily mounted on the magnet while the user is doing something else when the blade is not required.

One of the important advantages of the invention is that blades are kept protected and do not touch each other except along the safety portion so that the blade edges are protected from each other and the environment while in the dispenser magazine. Another advantage is that the device is capable of holding comfortably and safely a large volume of razor blades (one hundred blades at a time), greatly reducing the time utilized by a craftsman for employing a new blade. The device is also lightweight and low cost to manufacture.

To operate the device, the user merely needs to place a finger or thumb in the recessed portion of the floor to grasp the lowest blade in the magazine and by retracting that blade outwardly, the blade will be quickly and conveniently removed from the dispenser. While the user is working, the withdrawn blade can be attached to the magnet temporarily if desired. The blade retaining washer will keep the blades together even though the entire unit may be moved while working.

It is an object of this invention to provide a safety razor blade dispenser that is capable of holding a high volume of razor blades.

It is another object of this invention to provide an improved safety single edge blade dispenser that can be readily transported and provides for storing, transporting, and dispensing a large volume of blades quickly and conveniently.

Yet another object of this invention is to provide a blade dispenser of particular benefit to a skilled craftsman who uses a large number of single edge safety blades during a particular operation, and that can be carried on the person during a work operation.

In accordance with these and other objects which will be apparent hereinafter, the instant invention will now be described with particular reference to the accompanying drawings.

BRIEF DESCRIPTION OF THE DRAWINGS

FIG. 1 shows an exploded view of the present invention with a single blade shown.

FIG. 2 shows a side elevational view in cross section partially cut away of the dispensing opening in the device with three razor blades shown in position.

FIG. 3 shows a perspective view of the floor of the present invention.

FIG. 4 shows a side elevational view of the side wall, top, spindle, and belt attachment means utilized in the present invention FIG. 5 shows a back elevational view of the present invention showing the fourth wall, belt attaching means and tape used in the present invention. The device shown is transparent plastic and therefore the spindle is also visible.

PREFERRED EMBODIMENT OF THE INVENTION

Referring now to the drawings and specifically FIG. 1, the present invention is shown generally in an exploded view at 10 constructed in two separate segments to form the dispensing receptacle. The first segment includes a first rectangular wall 12 which may be of a transparent plastic connected to second wall 14 and third wall 16 all molded together with the bottom floor 18 into a rectangular box-like structure.

The adjoining segment to form the entire dispensing receptacle includes a fourth wall 26 that is joined with a top rectangular wall 28.

Of particular importance, wall 14 does not extend vertically completely to floor 18 but provides a narrow opening defined by the bottom wall edge and wall edge 22 which provides a space just large enough for one individual single edge safety razor to pass through. The floor 18 includes a finger or thumb-shaped recess 20 which enables the user to engage a portion of the safety razor for dispensing purposes. Just above the edge 22 is mounted a small magnet 24 permanently attached to wall 14. This magnet has several functions which are discussed in greater detail below.

The top wall 28 includes a central spindle 30 that may be annular in cross-sectional shape and is connected at its base to the top wall 28. The spindle 30 is also located in approximately the center of top wall 28. The length of the spindle is very critical to the operation of the device and is sized in length so that when top and side wall 26 are joined together to form the dispensing receptacle, there is sufficient space between the bottom floor 18 and the end tip 30*a* of the spindle that one razor blade will be allowed to be dispensed while the second razor blade on top of the bottom most razor blade will still have its central aperture 32*a* surrounding the spindle 30. As shown in FIG. 1, each razor blade 32 would be mounted so that the central aperture 32*a* receives the spindle 30 holding up to one hundred blades in a column along the spindle. A blade retaining device such as a lock-type washer 38 can be mounted on the spindle above the blades 32 so that it prevents the blades from rising vertically after several blades have been dispensed. This stabilizes the entire column of blades at all times.

FIG. 2 shows the dispensing operation with three blades 32 stacked upon one another adjacent the bottom opening formed between the floor 18 and the bottom edge of wall 14. Note that the opening is sized to receive the thickness of the larger portion of bottom blade 32 but will not permit the two blades above to pass through the opening. At the same time, spindle 30 has its end tip projecting in through the second blade in the stack but not in the first blade adjacent the floor 18. Also the recessed area 20 in floor 18 is such that a portion of the lowermost blade 32 can be grasped by the user for dispensing. Note also the proximity of magnet 24 which is attached by a suitable adhesive 26 to the outside of wall 14. The magnetic force emanating from magnet 24 is sufficient to effect the steel blades in the magazine to hold them in place. Once a blade has been dispensed, the magnet can also be used as a temporary storage for a blade when the blade is not in use by the user. In that case the blade would just be flush in contact with the magnet 24 and will be securely fastened until removed by the user. Note also the retaining device 38 which is positioned above the top blade for firmly holding the blades in position.

FIG. 3 shows floor 18 and the recessed area 20 in floor 18 that includes a removable tab 20*a* which would be removed once the entire dispensing receptacle is placed in operation.

FIG. 4 shows the top 28 and spindle 30 connected thereto and the fourth vertical wall 26 which has a belt attachment 36 connected firmly thereto. The belt attachment allows the entire dispensing receptacle filled with blades to be carried by the user for easy accessibility to additional blades when required.

The fourth vertical wall 26 and top 28 can be loaded with up to one hundred safety blades at the factory at which time the remaining walls and floor are securely joined together with the top and side wall 26 by a suitable adhesive tape 34 which is wrapped around the perimeter of at least walls 12 and 16 and vertical wall 26 firmly locking all the walls and top and bottom together as a unit.

The dimensions of the floor and ceiling walls are such that a safety razor blade will fit snugly in the device without the blade contacting any of the wall surfaces or each other to ensure that the sharpness and integrity of each blade is maintained. The spindle prevents any relative movement of each blade while it is mounted in the magazine.

The magnet 24 aids in stabilizing the lower column of the blades holding the blades and ensuring that they are stacked appropriately while another blade is dispensed. It also acts in ejecting the next blade and will hold down the last blade to be dispensed preventing it from accidentally being ejected. In addition, the magnet 24 can be used for storing temporarily a blade on the outside of the receptacle after it has been dispensed as discussed above.

In summary, the invention provides a user, such as a skilled craftsman, immediate access to up to one hundred single edge safety blades which can be unobtrusively carried while the user is working, for safely storing, transporting and allowing dispensing of a single blade at a time. The entire magazine can be manufactured inexpensively with the blades mounted in the device at the factory where the entire unit, including the blades, can be shipped to its ultimate destination. The blades themselves are protected from being damaged in a secure environment at all times.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A dispenser for dispensing single edge safety razor blades which provide for storage, transport, and individual dispensing comprising:

an enclosure having four side walls, a top wall and a bottom wall;

said enclosure including a dispensing spaced located at the base of one wall adjacent one edge of said bottom wall, said dispensing space being sized to permit only one single edge safety blade to pass therethrough; and a spindle connected to the top wall within said enclosure, said spindle being capable of receiving a plurality of safety blades having apertures disposed in said blades wherein said apertures fit and surround said spindle, said spindle length being such that the bottom most blade in the enclosure will not be engaged by said spindle, but the second blade on top of bottom blade will be engaged by the spindle; and magnetic means connected adjacent said dispensing opening to aid in holding the blades in the enclosure in place, to aid in dispensing, and to hold a blade already dispensed.

2. A blade dispensing device as in claim 1, including:

means attached to one of said enclosure walls on the outside for attaching said dispensing to a belt.

3. A blade dispenser as in claim 1, including:

a removable tab connected to said bottom floor within said floor forming a recess in said floor when said tab is removed to allow dispensing of said bottom most blade to permit contact by a thumb or finger within said recess.

4. A blade dispensing device as in claim 1, wherein:

said enclosure is formed from three side walls and a bottom floor uniformly joined together and a fourth side wall and top joined together, said three side walls and said floor joined to said fourth side wall and said top by a connecting means.

5. A blade dispensing device as in claim 4, wherein:

said connecting means is adhesive tape wrapped around said side walls.

* * * * *